US011373799B2

(12) United States Patent
Shiraki et al.

(10) Patent No.: US 11,373,799 B2
(45) Date of Patent: Jun. 28, 2022

(54) CHOKE COIL

(71) Applicant: Mitsubishi Electric Corporation, Tokyo (JP)

(72) Inventors: Yasuhiro Shiraki, Tokyo (JP); Katsuhiko Omae, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 735 days.

(21) Appl. No.: 16/329,832

(22) PCT Filed: Feb. 23, 2017

(86) PCT No.: PCT/JP2017/006783
§ 371 (c)(1),
(2) Date: Mar. 1, 2019

(87) PCT Pub. No.: WO2018/047372
PCT Pub. Date: Mar. 15, 2018

(65) Prior Publication Data

US 2019/0228905 A1 Jul. 25, 2019

(30) Foreign Application Priority Data

Sep. 8, 2016 (JP) ..... JP2016-175344

(51) Int. Cl.
*H01F 17/04* (2006.01)
*H01F 27/33* (2006.01)
(Continued)

(52) U.S. Cl.
CPC ..... *H01F 27/33* (2013.01); *H01F 17/06* (2013.01); *H01F 27/2828* (2013.01);
(Continued)

(58) Field of Classification Search
CPC ..... H01F 27/33; H01F 27/363; H01F 27/2828
(Continued)

(56) References Cited

U.S. PATENT DOCUMENTS 3,418,563 A * 12/1968 Grosu ..... H01F 29/02 336/147
3,753,189 A * 8/1973 Allen ..... H03H 7/0123 336/182

(Continued)

FOREIGN PATENT DOCUMENTS

JP 2-201906 A 8/1990
JP 7-130546 A 5/1995

(Continued)

OTHER PUBLICATIONS

Communication dated Apr. 23, 2020 from Intellectual Property INDIA in Indian Application No. 201947005953.

*Primary Examiner* — Ronald Hinson
(74) *Attorney, Agent, or Firm* — Sughrue Mion, PLLC; Richard C. Turner

(57) ABSTRACT

Provided is a choke coil capable of improving a noise reduction effect by sufficiently attenuating magnetic field coupling between the choke coil and a metal part. A connector connection line includes: a first connection line led out from a connector conductor side of a coil main body of a winding wire along a y-axis direction away from the coil main body; a second connection line led out from the first connection line at a corner portion of a first pier column or a second pier column along a x-axis direction away from a connector conductor; a third connection line led out from the second connection line along a z-axis direction toward a lower yoke; and a fourth connection line led out from the third connection line along the x-axis direction toward the connector conductor.

8 Claims, 8 Drawing Sheets

(51) Int. Cl.

| | |
|---|---|
| ***H01F 37/00*** | (2006.01) |
| ***H01F 27/29*** | (2006.01) |
| ***H01F 17/06*** | (2006.01) |
| ***H01F 27/36*** | (2006.01) |
| ***H01F 27/28*** | (2006.01) |
| ***H01F 27/32*** | (2006.01) |

(52) U.S. Cl.
CPC ..... *H01F 27/29* (2013.01); *H01F 27/324* (2013.01); *H01F 27/36* (2013.01); *H01F 27/363* (2020.08); *H01F 37/00* (2013.01)

(58) Field of Classification Search
USPC ..... 336/107, 221
See application file for complete search history.

(56) References Cited

U.S. PATENT DOCUMENTS

| | | | | |
|---|---|---|---|---|
| 3,932,804 | A * | 1/1976 | Allen | H04B 3/54 323/356 |
| 6,628,191 | B1 * | 9/2003 | Wobben | H01F 27/245 336/55 |
| 10,049,811 | B2 * | 8/2018 | Huang | H01F 30/02 |
| 2015/0123402 | A1 * | 5/2015 | Wagoner | F03D 9/255 336/170 |
| 2016/0064139 | A1 | 3/2016 | Chuang | |

FOREIGN PATENT DOCUMENTS

| | | | |
|---|---|---|---|
| JP | 10-241955 | A | 9/1998 |
| JP | 2002-299133 | A | 10/2002 |
| JP | 2014-017365 | A | 1/2014 |

* cited by examiner

CHOKE COIL

CROSS REFERENCE TO RELATED APPLICATIONS

This application is a National Stage of International Application No. PCT/JP2017/006783, filed on Feb. 23, 2017, which claims priority from Japanese Patent Application No. 2016-175344, filed on Sep. 8, 2016.

TECHNICAL FIELD

The present invention relates to a choke coil for use in electric devices and electronic devices.

BACKGROUND ART

Noise due to electromagnetic interference (EMI) is caused by high-speed switching operation of an inverter in a power conversion device configured to control, for example, an alternating current drive motor, which is a load device. The noise travels as conduction noise through a power supply line and an earth, and may therefore be transmitted to other electric devices, electronic devices, and the like to inflict adverse effects such as malfunction. In the following description, an electric device, an electronic device, or the like is simply referred to as "electric device or the like".

A noise filter is used in order to reduce the noise. The use of a choke coil as a noise filter has been known. There has been a problem in that the noise reduction effect of the choke coil drops when the choke coil is opposed to a connector or a similar metal part across a short distance, because of magnetic field coupling between the choke coil and the metal part.

There has been known a choke coil having a configuration in which each of paired winding wires is wound around a toroidal core and includes an input-side member, an input-side fold-back member, an output-side member, an output-side fold-back member, and a joining member, and the input-side member on the positive side and the input-side member on the negative side are bent outward from each other (see Patent Literature 1, for example).

CITATION LIST

Patent Literature

[PTL 1] JP 2014-17365 A

SUMMARY OF INVENTION

Technical Problem

In Patent Literature 1, however, the input-side member on the positive side and the input-side member on the negative side are bent outward from each other in order to facilitate attachment to surrounding members, and not to attenuate magnetic field coupling between the choke coil and a metal part by taking into consideration the positional relation between the choke coil and the metal part. Consequently, there is a problem in that the magnetic field coupling between the choke coil and the metal part cannot be attenuated sufficiently.

The problem that the magnetic field coupling between the choke coil and the metal part cannot be attenuated sufficiently is also because, in the choke coil described in Patent Literature 1, the winding wire is bent once, which does not put a long enough distance between the bent winding wire and the metal part.

The present invention has been made to solve the problems described above, and an object of the present invention is therefore to provide a choke coil capable of improving the noise reduction effect by sufficiently attenuating magnetic field coupling between the choke coil and a metal part.

Solution to Problem

According to one embodiment of the present invention, there is provided a choke coil, including: a coil main body including a magnetic body and a winding wire, the magnetic body forming a closed magnetic circuit in which an upper yoke and a lower yoke are arranged side by side along a z-axis direction, and a first pier column and a second pier column are arranged side by side along a y-axis direction orthogonal to the z-axis direction, the winding wire being wound around at least one of the first pier column and the second pier column; and a connector connection line configured to connect the winding wire and a connector conductor, the coil main body and the connector conductor being arranged parallel to an x-axis direction orthogonal to the z-axis direction and orthogonal to the y-axis direction, in which the connector connection line includes: a first connection line led out from the connector conductor side of the coil main body of the winding wire along the y-axis direction away from the coil main body; a second connection line led out from the first connection line at a corner portion of the first pier column or the second pier column along the x-axis direction away from the connector conductor; a third connection line led out from the second connection line along the z-axis direction toward the lower yoke; and a fourth connection line led out from the third connection line along the x-axis direction toward the connector conductor.

Advantageous Effects of Invention

According to the choke coil of the present invention, the connector connection line includes the first connection line led out from the connector conductor side of the coil main body of the winding wire along the y-axis direction away from the coil main body, the second connection line led out from the first connection line along the x-axis direction away from the connector conductor at the corner portion of the first pier column or the second pier column, the third connection line led out from the second connection line along the z-axis direction toward the lower yoke, and the fourth connection line led out from the third connection line along the x-axis direction toward the connector conductor. Magnetic field coupling between the choke coil and a metal part is thus attenuated sufficiently, thereby improving the noise reduction effect.

DESCRIPTION OF EMBODIMENTS

A description is now given of a choke coil according to preferred embodiments of the present invention referring to the accompanying drawings, and throughout the drawings, like or corresponding components are denoted by like reference symbols to describe those components.

First Embodiment

Figure 1:
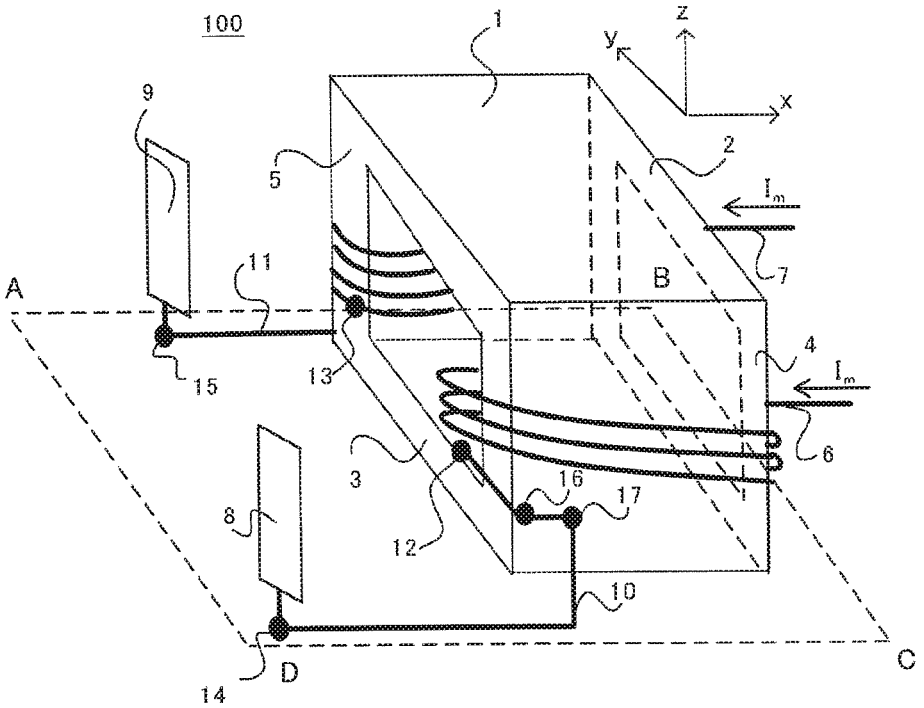
FIG. 1 is a perspective view for illustrating a choke coil according to a first embodiment of the present invention.

FIG. 1 is a perspective view for illustrating a choke coil according to a first embodiment of the present invention. In FIG. 1, a choke coil 100 includes an upper yoke 2, a lower yoke 3, a first pier column 4, and a second pier column 5, which make up a magnetic body 1; a positive winding wire 6 and a negative winding wire 7, which are wound around the first pier column 4 and the second pier column 4, respectively; and a positive connector connection line 10, which electrically connects the positive winding wire 6 and a connector positive conductor 8, and a negative connector connection line 11, which electrically connects the negative winding wire 7 and a connector negative conductor 9.

The upper yoke 2 and the lower yoke 3 are arranged side by side along a z-axis direction. The first pier column 4 and the second pier column 5 are arranged side by side along a y-axis direction. The upper yoke 2, the lower yoke 3, the first pier column 4, and the second pier column 5 are joined in the shape of a rectangular border to form a closed magnetic circuit. The magnetic body 1, the positive winding wire 6, and the negative winding wire 7 make up a coil main body.

The coil main body and the connector positive conductor 8 and the connector negative conductor 9 are arranged apart from each other along an x-axis direction. In other words, the connector positive conductor 8 and the connector negative conductor 9 are arranged apart from the coil main body along the x-axis direction. The connector positive conductor 8 and the connector negative conductor 9 are, for example, conductors inside power source connectors. The x-axis, the y-axis, and the z-axis are orthogonal to one another.

The positive winding wire 6 is connected to the positive connector connection line 10 at a positive winding wire bending point 12. The negative winding wire 7 is connected to the negative connector connection line 11 at a negative winding wire bending point 13. The positive connector connection line 10 is connected to the connector positive conductor 8 at a positive connector connection point 14, and the negative connector connection line 11 is connected to the connector negative conductor 9 at a negative connector connection point 15.

The positive connector connection line 10 includes a first connection line led out from the positive winding wire bending point 12 of the positive winding wire 6 along the y-axis direction away from the coil main body, a second connection line led out from a positive yx inflection point 16, which is a corner portion of the first pier column 4, along the x-axis direction away from the connector positive conductor 8, a third connection line led out from a positive xz inflection point 17 along the z-axis direction toward the lower yoke 3, and a fourth connection line led out from the third connection line along the x-axis direction toward the connector positive conductor 8. Though not shown, the negative connector connection line 11 is wired in the same manner.

Figure 2:
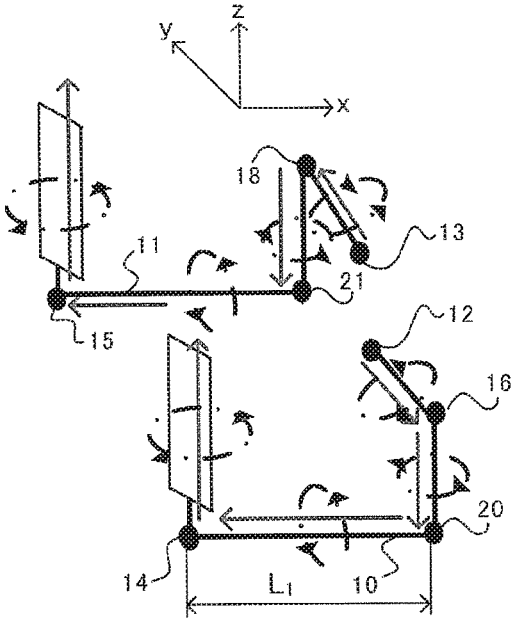
FIG. 2 is a perspective view for illustrating connector connection lines extracted from a choke coil of the related art.
Figure 3:
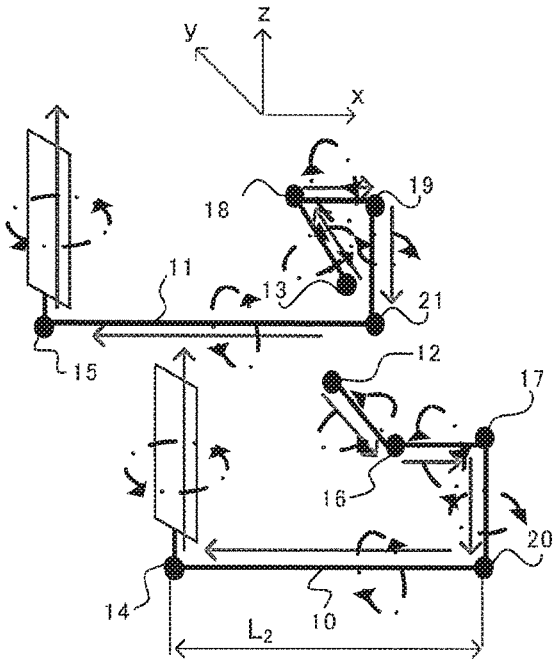
FIG. 3 is a perspective view for illustrating connector connection lines extracted from the choke coil according to the first embodiment of the present invention.

Effects of the choke coil 100 configured as above are now described with reference to FIG. 1 to FIG. 5. FIG. 2 is a perspective view for illustrating connector connection lines extracted from a choke coil of the related art. FIG. 3 is a perspective view for illustrating the connector connection lines extracted from the choke coil according to the first embodiment of the present invention.

In FIG. 2, the configuration of Patent Literature 1 is illustrated in a manner parallel to the positive connector connection line 10 and the negative connector connection line 11 of FIG. 1. In FIG. 3, the positive connector connection line 10 and the negative connector connection line 11 of FIG. 1 are illustrated. A current containing a noise component due to EMI flows in the positive connector connection line 10 and the negative connector connection line 11 illustrated in FIG. 2 and FIG. 3. This current is hereinafter referred to as "noise current".

A noise current flowing in the positive connector connection line 10 and the negative connector connection line 11 of FIG. 2 and a magnetic field generated by the noise current are described first. In the positive connector connection line 10 of FIG. 2, the noise current flows from the positive winding wire bending point 12 along the y-axis direction, the noise current flows from the positive yx inflection point 16 along the z-axis direction, the noise current flows from a positive zx inflection point 20 along the x-axis direction, and the noise current flows from the positive connector connection point 14 along the z-axis direction.

Similarly, in the negative connector connection line 11, the noise current flows from the negative winding wire bending point 13 along the y-axis direction, the noise current flows from a negative yx inflection point 18 along the z-axis direction, the noise current flows from a negative zx inflection point 21 along the x-axis direction, and the noise current flows from the negative connector connection point 15 along the z-axis direction.

The noise current flowing from the positive winding wire bending point 12 to the positive yx inflection point 16 generates a magnetic field in an x-z plane. The noise current flowing from the positive yx inflection point 16 to the positive zx inflection point 20 generates a magnetic field in an x-y plane. The noise current flowing from the positive zx inflection point 20 to the positive connector connection point 14 generates a magnetic field in a y-z plane. The noise current flowing in the connector positive conductor 8 through the positive connector connection point 14 generates a magnetic field in the x-y plane.

The magnetic field generated in the x-y plane by the noise current flowing from the positive yx inflection point 16 to the positive zx inflection point 20 and the magnetic field generated in the x-y plane by the noise current flowing in the connector positive conductor 8 through the positive connector connection point 14 are magnetic fields generated in the same plane, and both are interlinked. When magnetic fields are interlinked, mutual inductance is generated.

The direction of the noise current flowing from the positive yx inflection point 16 to the positive zx inflection point 20 is a −z-axis direction, and the direction of the noise current flowing in the connector positive conductor 8 through the positive connector connection point 14 is a +z-axis direction. The former noise current and the latter noise current are accordingly currents in directions opposite from each other, and the mutual inductance is subtracted.

The inductance of the positive connector connection line 10 accordingly takes a value that is obtained by subtracting, from the self-inductance of the positive connector connection line 10, twice the mutual inductance, and the inductance of the positive connector connection line 10 drops due to the mutual inductance. With the inductance dropped, the noise current increases and the noise reduction effect accordingly decreases. The situation of the positive connector connection line 10 applies to the negative connector connection line 11 as well.

A noise current flowing in the positive connector connection line 10 and the negative connector connection line 11 of FIG. 3 and a magnetic field generated by the noise current are described next. In the positive connector connection line 10 of FIG. 3, the noise current flows from the positive winding wire bending point 12 along the y-axis direction, the noise current flows from the positive yx inflection point 16 along the x-axis direction, the noise current flows from the positive xz inflection point 17 along the z-axis direction, the noise current flows from the positive zx inflection point 20 along the x-axis direction, and the noise current flows from the positive connector connection point 14 along the z-axis direction.

Similarly, in the negative connector connection line 11, the noise current flows from the negative winding wire bending point 13 along the y-axis direction, the noise current flows from the negative yx inflection point 18 along the x-axis direction, the noise current flows from the negative xz inflection point 19 along the z-axis direction, the noise current flows from the negative zx inflection point 21 along the x-axis direction, and the noise current flows from the negative connector connection point 15 along the z-axis direction.

The noise current flowing from the positive winding wire bending point 12 to the positive yx inflection point 16 generates a magnetic field in the x-z plane. The noise current flowing from the positive yx inflection point 16 to the positive xz inflection point 17 generates a magnetic field in the y-z plane. The noise current flowing from the positive xz inflection point 17 to the positive zx inflection point 20 generates a magnetic field in the x-y plane. The noise current flowing from the positive zx inflection point 20 to the positive connector connection point 14 generates a magnetic field in the y-z plane. The noise current flowing in the connector positive conductor 8 through the positive connector connection point 14 generates a magnetic field in the x-y plane.

The magnetic field generated in the x-y plane by the noise current flowing from the positive xz inflection point 17 to the positive zx inflection point 20 and the magnetic field generated in the x-y plane by the noise current flowing in the connector positive conductor 8 through the positive connector connection point 14 are magnetic fields generated in the same plane, and both are interlinked. When magnetic fields are interlinked, mutual inductance is generated.

The magnetic field generated in the y-z plane by the noise current flowing from the positive yx inflection point 16 to the positive xz inflection point 17 and the magnetic field generated in the y-z plane by the noise current flowing from the positive zx inflection point 20 to the positive connector connection point 14 are magnetic fields generated in the same plane, but both are excluded from the examination because those magnetic fields are irrelevant to the distance between the coil main body and the connector positive conductor 8.

In the connector connection lines of FIG. 2, the distance between a portion of the positive connector connection line 10 from the positive yx inflection point 16 to the positive zx inflection point 20 and a portion of the positive connector connection line 10 from the positive connector connection point 14 to the connector positive conductor 8, namely, the length of the third connection line, is denoted by $L_1$.

In the connector connection lines of FIG. 3, the distance between a portion of the positive connector connection line 10 from the positive xz inflection point 17 to the positive zx inflection point 20 and a portion of the positive connector connection line 10 from the positive connector connection point 14 to the connector positive conductor 8, namely, the length of the fourth connection line, is denoted by $L_2$.

The lengths $L_1$ and $L_2$ have a relationship "$L_2>L_1$" and, because the mutual inductance is in inverse proportion to the distance, the mutual inductance of the connector connection line of FIG. 3 is smaller than the mutual inductance of the connector connection line of FIG. 2. The choke coil 100 according to the first embodiment of the present invention can therefore have a larger inductance of a connector connection line than that in the choke coil of the related art, with the result that the noise reduction effect is improved.

Figure 4:
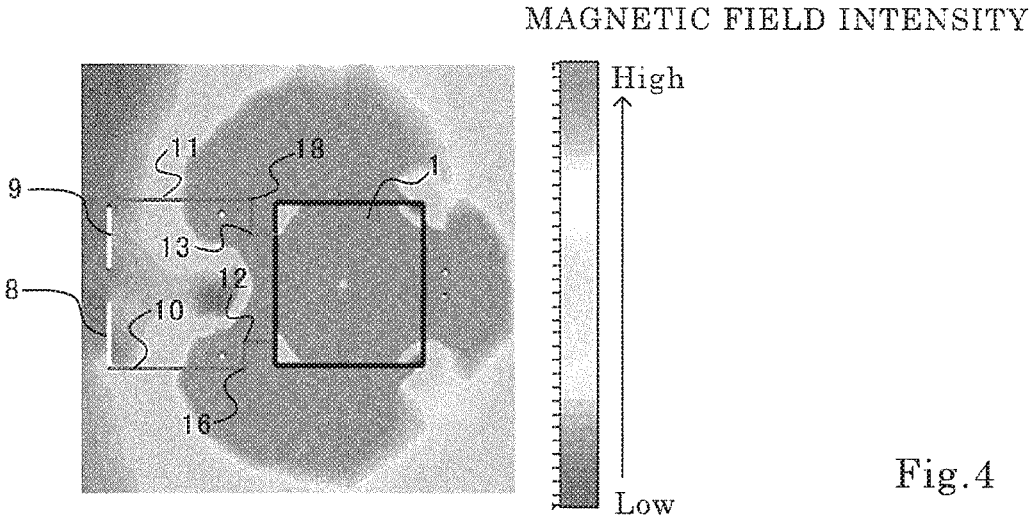
FIG. 4 is an explanatory diagram for illustrating a magnetic field distribution in the choke coil of the related art.
Figure 5:
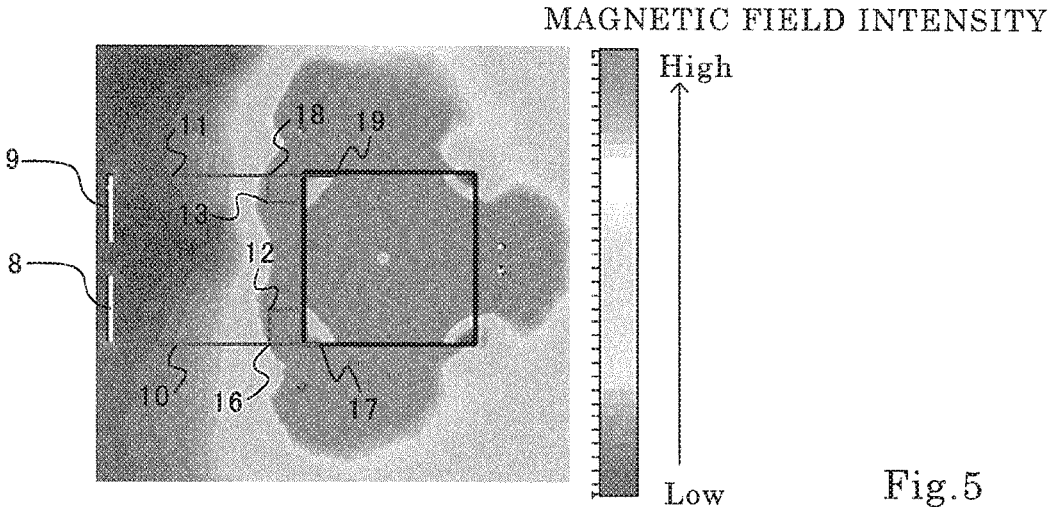
FIG. 5 is an explanatory diagram for illustrating a magnetic field distribution in the choke coil according to the first embodiment of the present invention.

FIG. 4 is an explanatory diagram for illustrating a magnetic field distribution in the choke coil of the related art. FIG. 5 is an explanatory diagram for illustrating a magnetic field distribution in the choke coil according to the first embodiment of the present invention. The sectional views of FIG. 4 and FIG. 5 are sectional views taken along the plane A-B-C-D of FIG. 1.

It can be seen that the magnetic field intensity decreases as the distance from the magnetic body 1 increases in FIG. 4 and FIG. 5 both. Compared to the choke coil of the related art, which is illustrated in FIG. 4, the only portion where the magnetic field intensity is high in the choke coil 100 according to the first embodiment of the present invention, which is illustrated in FIG. 5, is near the magnetic body 1. That is, the connector positive conductor 8 and the connector negative conductor 9 in the choke coil 100 of FIG. 5 are lower in magnetic field intensity than in the choke coil of the related art illustrated in FIG. 4.

In other words, the chance of interlinkage of magnetic fields generated from the positive connector connection line 10 and the negative connector connection line 11 with the connector positive conductor 8 and the connector negative conductor 9 is smaller in the choke coil 100 according to the first embodiment of the present invention than in the choke coil of the related art, which means that the noise reduction effect is improved.

As described above, according to the first embodiment, the connector connection line includes: the first connection line led out from the connector conductor side of the coil main body of the winding wire along the y-axis direction away from the coil main body; the second connection line led out from the first connection line at the corner portion of the first pier column or the second pier column along the x-axis direction away from the connector conductor; the third connection line led out from the second connection line along the z-axis direction toward the lower yoke; and the fourth connection line led out from the third connection line along the x-axis direction toward the connector conductor.

Magnetic field coupling between the choke coil and a metal part is thus attenuated sufficiently, thereby improving the noise reduction effect.

Figure 6:
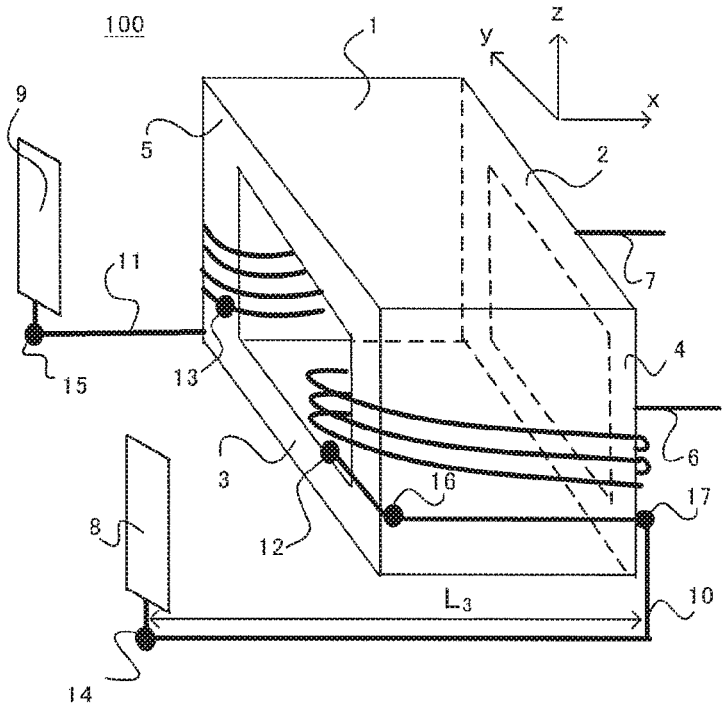
FIG. 6 is a perspective view for illustrating another choke coil according to the first embodiment of the present invention.

The positive connector connection line 10 in the first embodiment may be as illustrated in FIG. 6 in which the second connection line led out from the positive yx inflection point 16, which is a corner portion of the first pier column 4, along the x-axis direction away from the connector positive conductor 8 is extended to the positive xz inflection point 17 provided at an end portion of the coil main body opposite from the connector positive conductor 8, and is bent at the positive xz inflection point 17 along the z-axis direction toward the lower yoke 3.

This sets a length $L_3$ of the fourth connection line in the connector connection line illustrated in FIG. 6 so as to satisfy $L_3>L_2>L_1$ in relation to $L_1$ illustrated in FIG. 2 and $L_2$ illustrated in FIG. 3, and consequently decreases the mutual inductance even more, thereby improving the noise reduction effect.

The positive connector connection line 10 and the negative connector connection line 11 in the first embodiment are not limited to the wiring described above, and can be wired in other manners as long as the connector connection lines can change the distance in order to reduce interlinked magnetic fields on the same plane.

Second Embodiment

Figure 7:
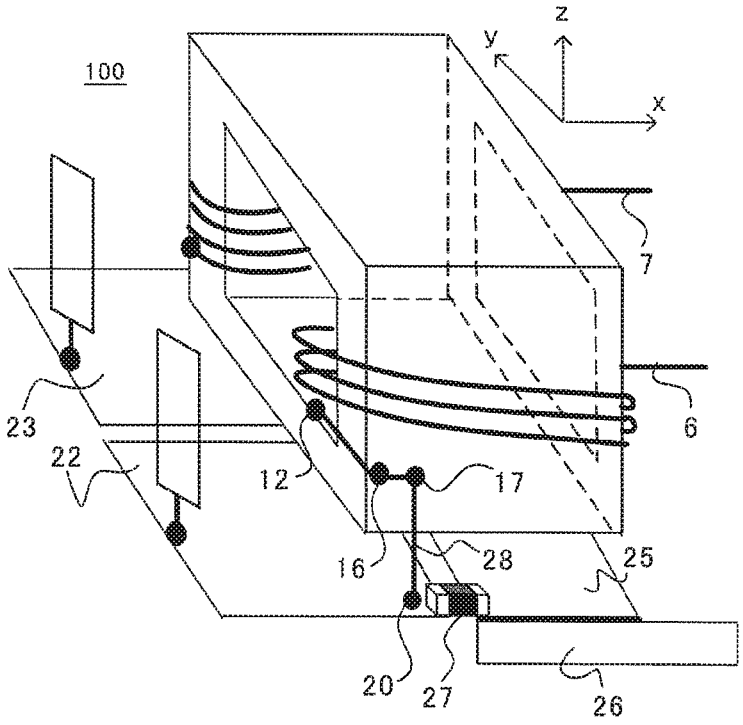
FIG. 7 is a perspective view for illustrating a choke coil according to a second embodiment of the present invention.

FIG. 7 is a perspective view for illustrating a choke coil according to a second embodiment of the present invention. The configuration of a coil main body in the second embodiment is the same as that in the first embodiment described above, and a description on the configuration of the coil main body is therefore omitted.

In FIG. 7, the positive winding wire 6 is connected to a positive flat connection line 28 at the positive winding wire bending point 12. The negative winding wire 7 is connected, though not shown, to a negative flat connection line at the negative winding wire bending point 13. The positive flat connection line 28 is led out from the positive winding wire bending point 12 along the y-axis direction, and is bent the x-axis direction at the positive yx inflection point 16. The positive flat connection line 28 is led out from the positive yx inflection point 16 along the x-axis direction, and is bent to the z-axis direction at the positive xz inflection point 17. The positive flat connection line 28 bent along the z-axis direction is connected to a positive flat board 22 at the positive zx inflection point 20.

Though not shown, the negative flat connection line is routed in the same manner as the positive flat connection line 28 to be connected to a negative flat board 23. The positive flat board 22 and the negative flat board 23 are both made of metal. The connector positive conductor 8 is connected to the positive flat board 22. The connector negative conductor 9 is connected to the negative flat board 23.

A GND flat board 25 connected to a casing 26 is placed under the magnetic body 1. The casing 26 is a casing made of metal and surrounding, though not shown, an electric device or the like in which an inverter or a similar noise source is installed.

The positive flat board 22 and the GND flat board 25 are connected by a common mode capacitor 27. Similarly, the negative flat board 23 and the GND flat board 25 are connected by another common mode capacitor (not shown). A small-sized capacitor, for example, a chip capacitor, is suitable as the common mode capacitor 27.

Figure 8:
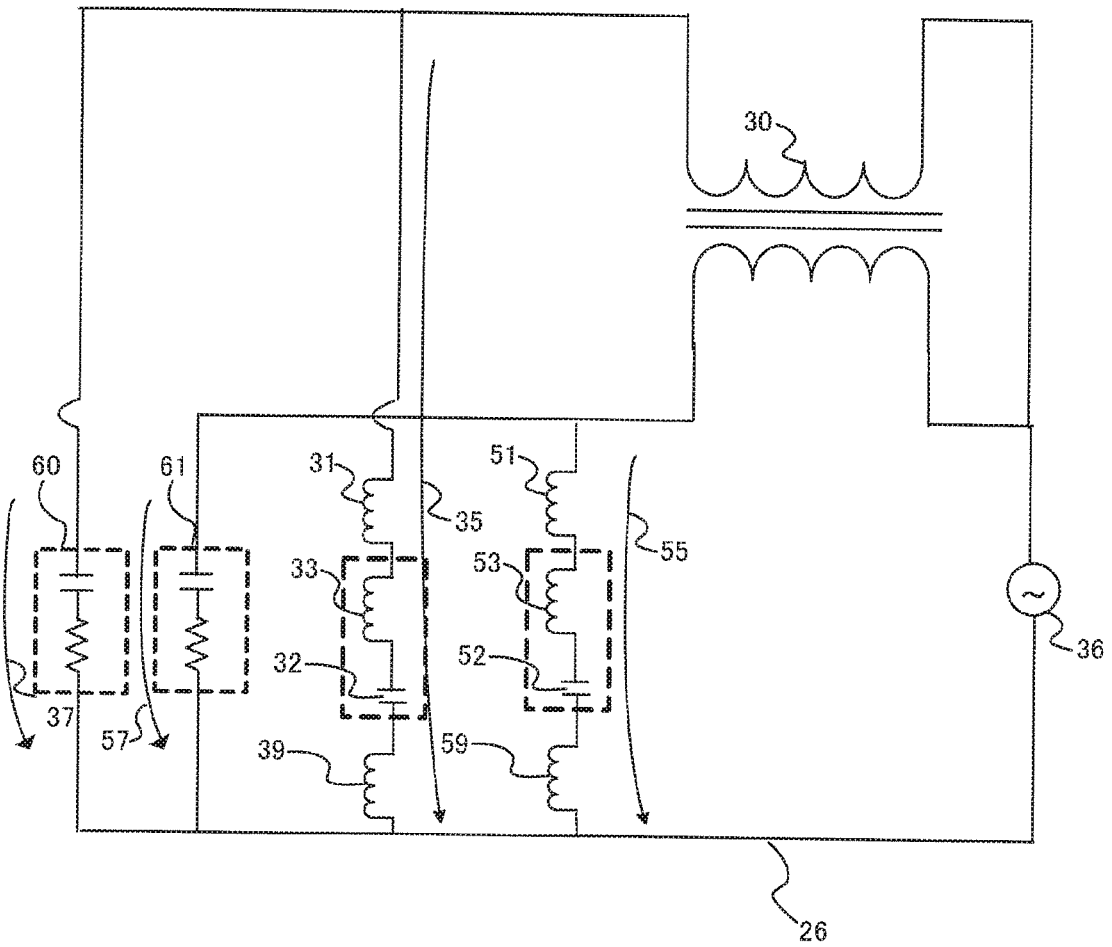
FIG. 8 is an equivalent circuit diagram for illustrating the choke coil according to the second embodiment of the present invention.

Effects of the choke coil 100 configured as above are now described with reference to FIG. 7 and FIG. 8. FIG. 8 is an equivalent circuit diagram for illustrating the choke coil according to the second embodiment of the present invention. The choke coil 100 is often used in combination with the common mode capacitor 27.

In FIG. 8, the inductance of the choke coil 100, a positive wiring inductance, the capacitance of the common mode capacitor 27, and the parasitic inductance of the common mode capacitor 27 are denoted by 30, 31, 32, and 33, respectively. A noise current running from the positive pole via the common mode capacitor 27 is denoted by 35. A noise measurement device is denoted by 60. A noise current running via the noise measurement device 60 is denoted by 37. Similarly, a negative wiring inductance is denoted by 51. The capacitance of the another common mode capacitor (not shown) is denoted by 52. The parasitic inductance of the common mode capacitor is denoted by 53. Another noise measurement device is denoted by 61. A noise current running through the noise measurement device 61 is denoted by 57. An inverter or a similar noise source having a voltage that fluctuates in relation to the casing 26 is denoted by 36.

A noise current generated by the noise source 36 propagates to the positive winding wire 6 and the negative winding wire 7 in the same phase. The noise current flows further from the positive winding wire 6 to the positive flat connection line 28, and from the negative winding wire 7 to the negative flat connection line (not shown). In this case, the noise reduction effect can be improved by setting large currents as the noise current 35, which bypasses the positive-side common mode capacitor 27, and as the noise current 55, which bypasses the negative-side common mode capacitor, and setting small currents as the noise current 37 running via the measurement device 60 and the noise current 57 running via the measurement device 61.

In order to bypass the common mode capacitor 27, the positive wiring inductance 31, the parasitic inductance 33 of the common mode capacitor 27, and the inductance 39 of the GND flat board, which are illustrated in FIG. 8, are required to be set small. It is difficult to reduce the parasitic inductance 33 of the common mode capacitor 27 in this case because the parasitic inductance 33 depends on the characteristics of parts of the common mode capacitor 27.

In order to bypass the negative-side common mode capacitor, the negative wiring inductance 51, the parasitic inductance 53 of the common mode capacitor, and the inductance 59 of the GND flat board, which are illustrated in FIG. 8, are required to be set small. It is difficult to reduce the parasitic inductance 53 of the common mode capacitor in this case because the parasitic inductance 53 depends on the characteristics of parts of the common mode capacitor.

The positive wiring inductance 31, on the other hand, decreases as the length from the positive zx inflection point 20 to the common mode capacitor 27 is made shorter, and as a portion of the conductor from the positive zx inflection point 20 to the common mode capacitor 27 is made wider.

Similarly, the negative wiring inductance 51 decreases as the length from the negative zx inflection point to the common mode capacitor, which are not shown, is made shorter, and as a portion of the conductor from the negative zx inflection point to the common mode capacitor is made wider.

By employing a flat board shape such as that of the positive flat board 22, the noise current 35, which bypasses the common mode capacitor 27, can be made large while the noise current running via a power source 38 is made small, and the noise reduction effect is accordingly improved. The description given here about the noise current superimposed on the positive wiring line 6 and the positive flat connection line 28 applies to the negative wiring line 7 and the negative flat connection line (not shown) as well.

As described above, according to the second embodiment, the winding wire includes: the positive winding wire to be connected to the connector positive conductor via the positive connector connection line; and the negative winding wire to be connected to the connector negative conductor via the negative connector connection line. The choke coil further includes the first flat board, the second flat board, and the third flat board, which are placed on the same plane under the lower yoke, which are insulated from one another, and which are made of metal. The positive connector connection line and the connector positive conductor are connected to the first flat board. The negative connector connection line and the connector negative conductor are connected to the second flat board. A casing made of metal is connected to the third flat board. The first flat board and the third flat board are connected to each other by a capacitor, and the second flat board and the third flat board are connected to each other by another capacitor.

The noise reduction effect can thus be improved by decreasing the parasitic inductances of the capacitors when the noise current flowing in the positive connector connection line and the noise current flowing in the negative connector connection line are in the same direction.

Third Embodiment

Figure 9:
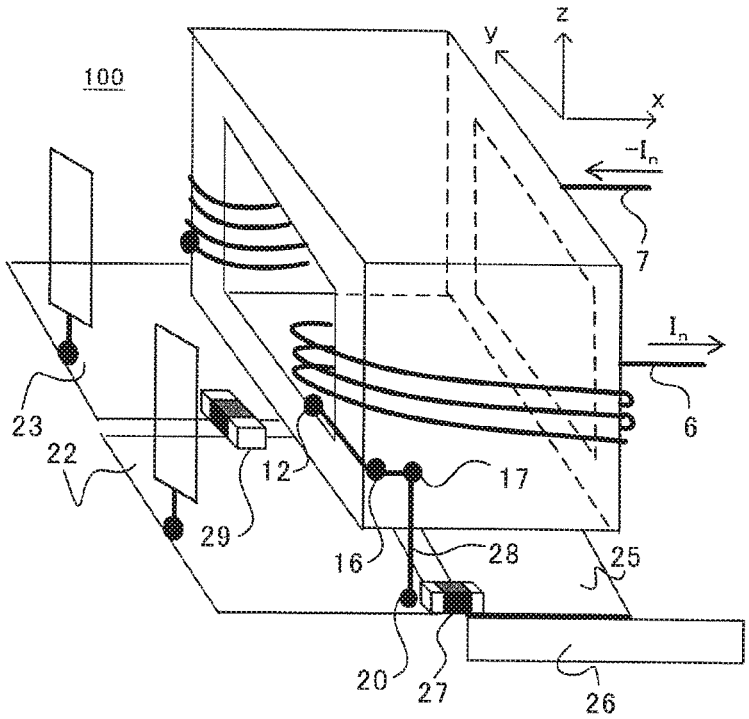
FIG. 9 is a perspective view for illustrating a choke coil according to a third embodiment of the present invention.

FIG. 9 is a perspective view for illustrating a choke coil according to a third embodiment of the present invention. The choke coil 100 of FIG. 9 is obtained by providing a normal mode capacitor 29 between the positive flat board 22 and the negative flat board 23 in the choke coil 100 illustrated in FIG. 7. The rest of the configuration of the third embodiment is the same as that in the second embodiment described above, and hence a description on the rest of the configuration is omitted.

Effects of the choke coil 100 configured as above are now described. In FIG. 9, the normal mode capacitor 29 is provided between the positive flat board 22 and the negative flat board 23 in order to bypass a noise current $I_n$, which flows in the positive winding wire 6, when the noise current $I_n$ and a noise current $-I_n$, which flows in the negative winding wire 7, are in directions opposite from each other.

In this case, the inductance of a portion from the positive zx inflection point 20 to the normal mode capacitor 29 behaves as an inhibiting factor when the noise current $I_n$ attempts to bypass the normal mode capacitor 29. The inductance has characteristics of being proportional to the length and inversely proportional to the width.

Accordingly, the inductance is reduced and the bypassing at the normal mode capacitor 29 is facilitated by connecting the portion from the positive zx inflection point 20 to the normal mode capacitor 29 with a wide conductor such as the positive flat board 22 as illustrated in FIG. 9.

With the noise current $I_n$ bypassed at the normal mode capacitor 29, the chance of a noise current leaking to the power source side via the connector positive conductor 8 and the connector negative conductor 9 is reduced. Substantially the same effects are obtained also when the common mode capacitor 27 is removed from the choke coil 100 according to the third embodiment of the present invention.

As described above, according to the third embodiment, the winding wire includes: the positive winding wire to be connected to the connector positive conductor via the positive connector connection line; and the negative winding wire to be connected to the connector negative conductor via the negative connector connection line. The choke coil further includes the first flat board and the second flat board, which are placed on the same plane under the lower yoke, which are insulated from each other, and which are made of metal. The positive connector connection line and the connector positive conductor are connected to the first flat board. The negative connector connection line and the connector negative conductor are connected to the second flat board. The first flat board and the second flat board are connected to each other by the capacitor.

The noise reduction effect can thus be improved by decreasing the parasitic inductances of the capacitors when the noise current flowing in the positive connector connection line and the noise current flowing in the negative connector connection line are in the opposite directions from each other.

Fourth Embodiment

Figure 10:
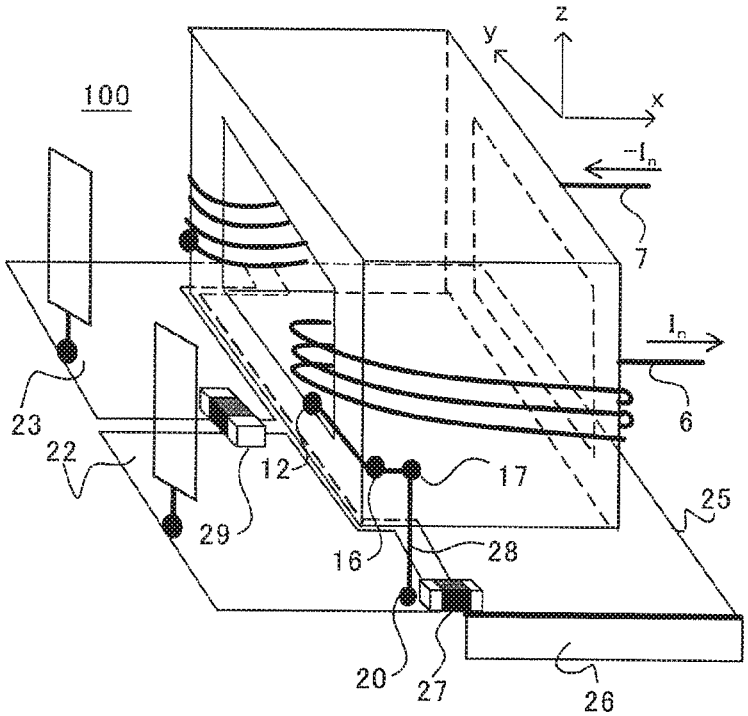
FIG. 10 is a perspective view for illustrating a choke coil according to a fourth embodiment of the present invention.

FIG. 10 is a perspective view for illustrating a choke coil according to a fourth embodiment of the present invention. The choke coil 100 of FIG. 10 is obtained by changing the shapes of the positive flat board 22, the negative flat board 23, and the GND flat board 25 in the choke coil 100 illustrated in FIG. 9. The rest of the configuration of the fourth embodiment is the same as that in the third embodiment described above, and hence a description on the rest of the configuration is omitted.

The GND flat board 25 here has a convex shape so as to cover a bottom surface of the lower yoke 3, which is one of the constituents of the magnetic body 1. Specifically, the GND flat board 25 has a shape in which its length in a y direction is longer than the length of the lower yoke 3 in the y direction, and is convexed in a −x direction by an amount equivalent to a bottom surface portion of the lower yoke 3. The positive flat board 22, the negative flat board 23, and the GND flat board 25 are arranged so that sides of the GND flat board 25 that are nearer to the connector positive conductor 8 and the connector negative conductor 9 face the positive flat board 22 and the negative flat board 23 across a minute slit.

Effects of the choke coil 100 configured as above are now described. In FIG. 10, the area of contact between the GND flat board 25 and the casing 26 can be set large by shaping the GND flat board 25 into a convex shape and thereby giving the GND flat board 25 a large area. The impedance of the GND flat board 25 can be reduced in this manner. The impedance of a portion leading to the casing 26 through the positive flat connection line 28, the negative flat connection line, the common mode capacitor 27, and the GND flat board 25 can accordingly be made small.

Noise currents that cause the coupling of interlinked magnetic fields in the connector positive conductor 8 and the connector negative conductor 9 can thus be bypassed to the casing 26 via the common mode capacitor 27 and the GND flat board 25 from the positive flat connection line 28 and the negative flat connection line, with the result that the noise reduction effect is improved.

As described above, according to the fourth embodiment, the third flat board is shaped so as to cover the bottom surface of the lower yoke. Specifically, the third flat board is longer along the y-axis direction than the length of the lower yoke along the y-axis direction. The first flat board and the second flat board, and the third flat board are arranged so that the side of the third flat board that is nearer to the connector positive conductor and the connector negative conductor face the first flat board and the second flat board across a slit.

The noise reduction effect can consequently be improved.

Fifth Embodiment

Figure 11:
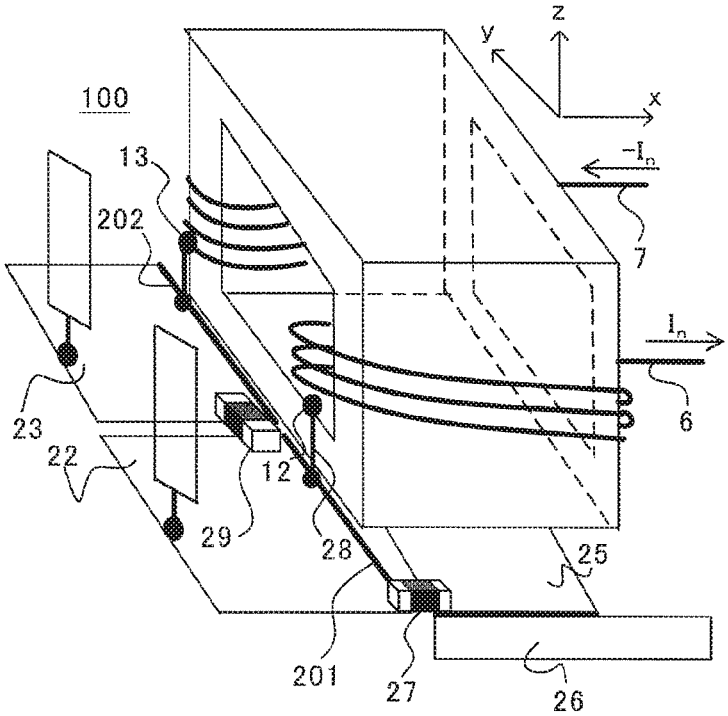
FIG. 11 is a perspective view for illustrating a choke coil according to a fifth embodiment of the present invention.

FIG. 11 is a perspective view for illustrating a choke coil according to a fifth embodiment of the present invention. The configuration of a coil main body in the fifth embodiment is the same as that in the first embodiment described above, and a description on the configuration of the coil main body is therefore omitted. In FIG. 11, the positive winding wire 6 is connected to the positive flat connection line 28 at the positive winding wire bending point 12. The negative winding wire 7 is connected to the negative flat connection line at the negative winding wire bending point 13.

The positive flat connection line 28 is led out in a −z direction, and connected to a side 201 of the positive flat board 22, which is the side closest to the GND flat board 25 out of the sides of the positive flat board 22. The positive flat connection line 28 may be bent to be connected, instead of being led out linearly in the −z direction.

Similarly to the positive flat connection line 28, the negative flat connection line is led out in the −z direction, and connected to a side 202 of the negative flat board 23, which is the side closest to the GND flat board 25 out of the sides of the negative flat board 23. The positive flat board 22 and the negative flat board 23 are made of metal. The connector positive conductor 8 is connected to the positive flat board 22, and the connector negative conductor 9 is connected to the negative flat board 23.

The GND flat board 25 connected to the casing 26 is placed under the magnetic body 1. The casing 26 is a casing made of metal and surrounding, though not shown, an electric device or the like in which an inverter or a similar noise source is installed.

The positive flat board 22 and the GND flat board 25 are connected by a common mode capacitor 27. Similarly, the negative flat board 23 and the GND flat board 25 are connected by another common mode capacitor (not shown). A small-sized capacitor, for example, a chip capacitor, is suitable as the common mode capacitor 27.

The normal mode capacitor 29 is provided between the positive flat board 22 and the negative flat board 23. Electrodes of the normal mode capacitor 29 are connected to the side 201, which is the side closest to the GND flat board 25 out of the sides of the positive flat board 22, and the side 202, which is the side closest to the GND flat board 25 out of the sides of the negative flat board 23.

Effects of the choke coil 100 configured as above is now described. In FIG. 11, the distance from the common mode capacitor 27 to a connection point at which connection to the positive flat connection line 28 is made on the positive flat board 22 is shortened by connecting the positive flat connection line 28 to the side 201 of the positive flat board 22. The positive wiring inductance 31 illustrated in FIG. 8 is decreased as a result.

The noise reduction effect can therefore be improved by setting a large value to the noise current 35, which is to bypass the common mode capacitor 27, and setting a small value to the noise current 37 running via the power source 38 relative to a noise current generated by voltage fluctuation of the noise source 36 in response to the switching of the inverter or the like.

In addition, the negative flat connection line is connected to the side 202 of the negative flat board 23 in FIG. 11, thereby shortening the distance from the common mode capacitor 27 to a connection point at which connection to the negative flat connection line is made on the negative flat board 23. This contributes to the improvement of the noise reduction effect.

In addition, the positive flat connection line 28 is connected to the side 201 of the positive flat board 22 in FIG. 11, thereby shortening the distance from the normal mode capacitor 29 to the connection point at which connection to the positive flat connection line 28 is made on the positive flat board 22. This contributes to the improvement of the noise reduction effect.

In addition, the negative flat connection line is connected to the side 202 of the negative flat board 23 in FIG. 11, thereby shortening the distance from the normal mode capacitor 29 to the connection point at which connection to the negative flat connection line is made on the negative flat board 23. This contributes to the improvement of the noise reduction effect.

As described above, according to the fifth embodiment, the winding wire includes: the positive winding wire to be connected to the connector positive conductor via the positive connector connection line; and the negative winding wire to be connected to the connector negative conductor via the negative connector connection line. The choke coil further includes the first flat board and the second flat board, which are placed on the same plane under the lower yoke, which are insulated from each other, and which are made of metal. The positive connector connection line is connected to the point on the first flat board that faces the second flat board via insulation and is closest to the second flat board. The negative connector connection line is connected to the point on the second flat board that faces the first flat board via insulation and is closest to the first flat board. Moreover, the winding wire includes: the positive winding wire to be connected to the connector positive conductor via the positive connector connection line; and the negative winding wire to be connected to the connector negative conductor via the negative connector connection line. The choke coil further includes the first flat board, the second flat board, and the third flat board, which are placed on the same plane under the lower yoke, which are insulated from one another, and which are made of metal. The positive connector connection line is connected to the point on the first flat board that faces the third flat board via insulation and is closest to the third flat board. The negative connector connection line is connected to the point on the second flat board that faces the third flat board via insulation and closest to the third flat board.

The noise reduction effect can consequently be improved.

The magnetic body 1, which is described as the closed magnetic circuit made up of the upper yoke 2, the lower yoke 3, the first pier column 4, and the second pier column 5, and shaped like the rectangular border in the first embodiment to the fifth embodiment, is not limited thereto, and may not have the shape of the rectangular border as long as the magnetic body is a closed magnetic circuit.

The descriptions of the first embodiment to the fifth embodiment take two types of winding wound around the magnetic body 1, the positive winding wire 6 and the negative winding wire 7, as an example. However, an embodiment according to the present invention is not limited thereto, and one type of winding or three or more types of winding may be used.

Figure 12:
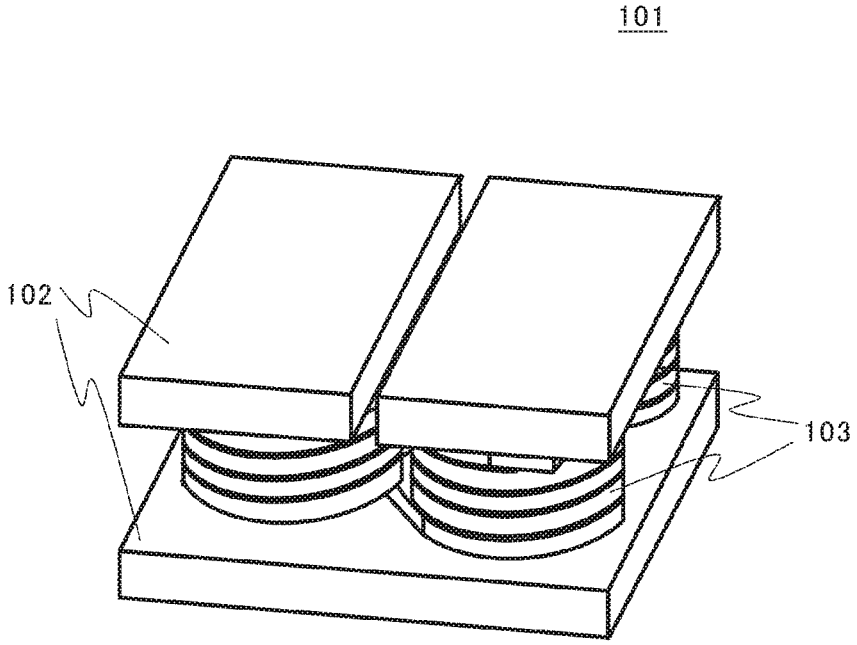
FIG. 12 is a diagram for illustrating the overall configuration of a dual mode choke coil.

The magnetic body 1 and the winding wires in the first embodiment to the fifth embodiment are applicable to a dual mode choke coil as well. FIG. 12 is a diagram for illustrating the overall configuration of a dual mode choke coil. In FIG. 12, a dual mode choke coil 101 includes a dual mode core portion 102 and a coil portion 103.

Figure 13:
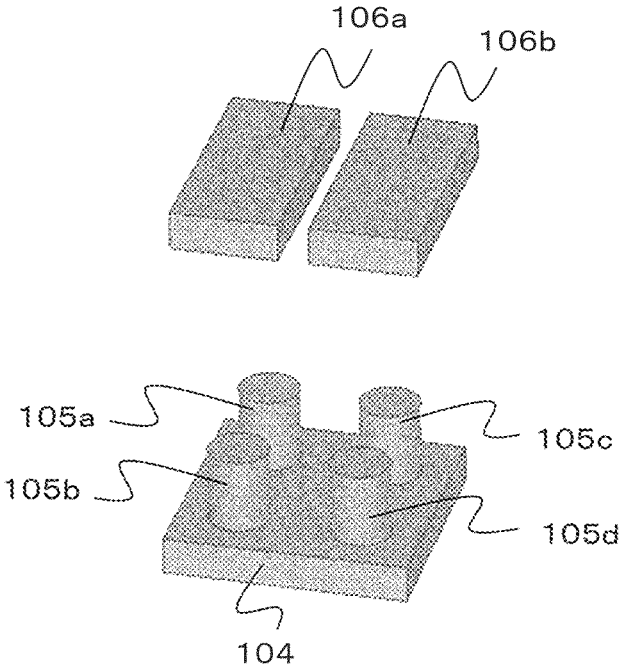
FIG. 13 is an exploded perspective view for illustrating a dual mode core portion of the dual mode choke coil illustrated in FIG. 12.

FIG. 13 is an exploded perspective view of the dual mode core portion of the dual mode choke coil. In FIG. 13, the dual mode core portion 102 includes a lower core 104, a first upper core 106*a*, and a second upper core 106*b*.

The lower core 104 is constructed from a magnetic body in which a first columnar member 105*a*, a second columnar member 105*b*, a third columnar member 105*c* and a fourth columnar member 105*d* are provided on a flat board, and the third columnar member 105*c* and the fourth columnar member 105*d* are arranged parallel to axes formed by the first columnar member 105*a* and the second columnar member 105*b*.

The first upper core 106*a* is constructed from a magnetic body shaped like a flat board and brought into contact with the tops of the first columnar member 105*a* and the second columnar member 105*b*. The second upper core 106*b* is arranged so that there is a gap between the first upper core 106*a* and the second upper core 106*b*, and is constructed from a magnetic body shaped like a flat board and brought into contact with the tops of the third columnar member 105*c* and the fourth columnar member 105*d*.

Figure 14:
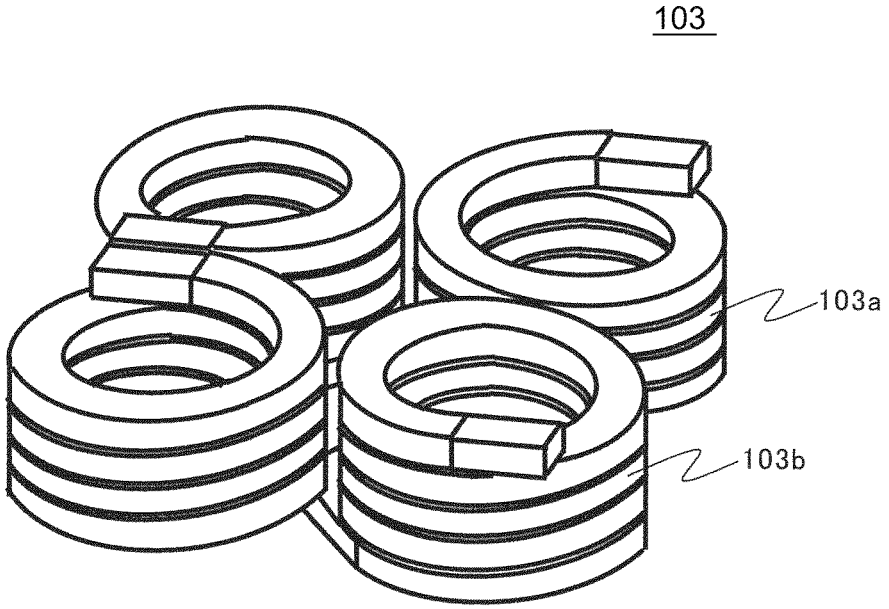
FIG. 14 is a perspective view for illustrating a coil portion of the dual mode choke coil illustrated in FIG. 12.

FIG. 14 is a perspective view for illustrating the coil portion of the dual mode choke coil. In FIG. 14, the coil portion 103 includes a first coil 103*a* and a second coil 103*b*.

The first coil 103*a* is constructed from two coil conductors connected in series and wound around the first columnar member 105*a* and the third columnar member 105*c* so that magnetic fluxes generated in the two coil conductors are in directions opposite from each other.

The second coil 103*b* is constructed from two coil conductors connected in series and wound around the second columnar member 105*b* and the fourth columnar member 105*d* so that magnetic fluxes generated in the two coil conductors are in directions opposite from each other. The second coil 103*b* is also arranged so that the magnetic flux generated by the coil conductor that is wound around the first columnar member 105*a* and the magnetic flux generated by the coil conductor that is wound around the second columnar member 105*b* are in the same direction.

REFERENCE SIGNS LIST

1 magnetic body, 2 upper yoke, 3 lower yoke, 4 first pier column, 5 second pier column, 6 positive winding wire, 7 negative winding wire, 8 connector positive conductor, 9 connector negative conductor, 10 positive connector connection line, 11 negative connector connection line, 12 positive winding wire bending point, 13 negative winding wire bending point, 14 positive connector connection point, 15 negative connector connection point, 16 positive yx inflection point, 17 positive xz inflection point, 18 negative yx inflection point, 19 negative xz inflection point, 20 positive zx inflection point, 21 negative zx inflection point, 22 positive flat board, 23 negative flat board, 25 GND flat board, 26 casing, 27 common mode capacitor, 28 positive flat connection line, 29 normal mode capacitor, 30 inductance of choke coil, 31 positive wiring inductance, 32 capacitance of common mode capacitor, 33 parasitic inductance of common mode capacitor, 34 inverter or similar noise source, 35 noise current running via common mode capacitor, 36 inverter or similar noise source, 37 noise current running via power source, 38 power source, 39 inductance of GND flat board, 100 choke coil, 101 dual mode choke coil, 102 dual mode core portion, 103 coil portion, 103*a* first coil, 103*b* second coil, 104 lower core, 105*a* first columnar member, 105*b* second columnar member, 105*c* third columnar member, 105*d* fourth columnar member, 106*a* first upper core, 106*b* second upper core, 201 side of positive flat board which is side closest to GND flat board, 202 side of negative flat board which is side closest to GND flat board.

The invention claimed is:

1. A choke coil, comprising:

a coil main body including a magnetic body and a winding wire, the magnetic body forming a closed magnetic circuit in which an upper yoke and a lower yoke are arranged side by side along a z-axis direction, and a first pier column and a second pier column are arranged side by side along a y-axis direction orthogonal to the z-axis direction, the winding wire being wound around at least one of the first pier column and the second pier column; and a connector connection line configured to connect the winding wire and a connector conductor, the coil main body and the connector conductor being arranged parallel to an x-axis direction orthogonal to the z-axis direction and orthogonal to the y-axis direction, wherein the connector connection line includes:

a first connection line led out from the connector conductor side of the coil main body of the winding wire along the y-axis direction away from the coil main body;

a second connection line led out from the first connection line at a corner portion of the first pier column or the second pier column along the x-axis direction away from the connector conductor;

a third connection line led out from the second connection line along the z-axis direction toward the lower yoke; and a fourth connection line led out from the third connection line along the x-axis direction toward the connector conductor.

2. The choke coil according to claim 1, wherein the second connection line is extended to an end portion of the first pier column or the second pier column that is farthest from the connector conductor.

3. The choke coil according to claim 1, wherein the winding wire includes:

a positive winding wire to be connected to a connector positive conductor via a positive connector connection line; and a negative winding wire to be connected to a connector negative conductor via a negative connector connection line, wherein the choke coil further comprises a first flat board and a second flat board, which are placed on the same plane under the lower yoke, which are insulated from each other, and which are made of metal, wherein the positive connector connection line and the connector positive conductor are connected to the first flat board, wherein the negative connector connection line and the connector negative conductor are connected to the second flat board, and wherein the first flat board and the second flat board are connected to each other by a capacitor.

4. The choke coil according to claim 1, wherein the magnetic body and the winding wire are applied to a dual mode choke coil.

5. The choke coil according to claim 1, wherein the winding wire includes:

a positive winding wire to be connected to a connector positive conductor via a positive connector connection line; and a negative winding wire to be connected to a connector negative conductor via a negative connector connection line, wherein the choke coil further comprises a first flat board, a second flat board, and a third flat board, which are placed on the same plane under the lower yoke, which are insulated from one another, and which are made of metal, wherein the positive connector connection line and the connector positive conductor are connected to the first flat board, wherein the negative connector connection line and the connector negative conductor are connected to the second flat board, wherein a casing made of metal is connected to the third flat board, and wherein the first flat board and the third flat board are connected to each other by a capacitor, and the second flat board and the third flat board are connected to each other by another capacitor.

6. The choke coil according to claim 5, wherein the third flat board is shaped so as to cover a bottom surface of the lower yoke.

7. The choke coil according to claim 6, wherein the third flat board is longer along the y-axis direction than a length of the lower yoke along the y-axis direction.

8. The choke coil according to claim 6, wherein the first flat board and the second flat board, and the third flat board are arranged so that a side of the third flat board that is nearer to the connector positive conductor and the connector negative conductor faces the first flat board and the second flat board across a slit.

* * * * *